US008449723B2

(12) United States Patent
Yamazaki

(10) Patent No.: US 8,449,723 B2
(45) Date of Patent: May 28, 2013

(54) SHOE PRESS BELT

(75) Inventor: Shintaro Yamazaki, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 9 days.

(21) Appl. No.: 13/203,174

(22) PCT Filed: Feb. 25, 2010

(86) PCT No.: PCT/JP2010/001281

§ 371 (c)(1),
(2), (4) Date: Aug. 24, 2011

(87) PCT Pub. No.: WO2010/098106

PCT Pub. Date: Sep. 2, 2010

(65) Prior Publication Data

US 2011/0303383 A1 Dec. 15, 2011

(30) Foreign Application Priority Data

Feb. 26, 2009 (JP) ..... 2009-043541

(51) Int. Cl.
*D21F 3/00* (2006.01)

(52) U.S. Cl.
USPC ..... 162/358.4

(58) Field of Classification Search
USPC ..... 162/358.4, 358.3, 901; 428/167
See application file for complete search history.

(56) References Cited

U.S. PATENT DOCUMENTS 4,978,428 A * 12/1990 Cronin et al. ..... 162/358.4
5,766,421 A 6/1998 Aufrecht
6,419,795 B1 * 7/2002 Dutt ..... 162/358.4
6,929,718 B2 * 8/2005 Kimura ..... 162/358.4
7,384,516 B2 * 6/2008 Fitzpatrick et al. ..... 162/358.4
7,909,965 B2 3/2011 Yazaki et al.

(Continued)

FOREIGN PATENT DOCUMENTS

DE 44 11 621 10/1995
EP 1 350 889 10/2003
EP 1 985 750 10/2008

OTHER PUBLICATIONS

International Search Report issued Jun. 9, 2010 in PCT/JP10/001281 filed Feb. 25, 2010.

*Primary Examiner* — Mark Halpern
(74) *Attorney, Agent, or Firm* — Oblon, Spivak, McClelland, Maier & Neustadt, L.L.P.

(57) ABSTRACT

A shoe press belt includes a substrate, a wet paper web-side layer provided on the outer side of the substrate; and a shoe-side layer on the inner side; the wet paper web-side layer and the shoe-side layer are made from a high-polymer elastic material. The surface layer of the wet paper web-side layer includes concave water catching parts and land parts which are projecting parts occurring due to formation of the water catching parts. The occurrence of cracks in the surface part of the land part and the bottom part and corner parts of the water catching part of the shoe press belt is suppressed by setting the hardness of the surface part of the land part at a relatively higher value than the hardness of the bottom part of the water catching part. Thereby, occurrence of cracks in the surface part of the land parts and the bottom part of the water catching part in a shoe press belt having water catching parts and land parts in the surface layer of the wet paper web-side layer can be suppressed.

6 Claims, 4 Drawing Sheets

(a)

(b)

U.S. PATENT DOCUMENTS 7,943,013 B2 5/2011 Yazaki et al.
7,947,154 B2 5/2011 Yazaki et al.
7,955,475 B2 6/2011 Yazaki et al.
2004/0026057 A1 2/2004 Watanabe et al.
2009/0038770 A1 2/2009 Ishii
2010/0186918 A1 7/2010 Ishino et al.

* cited by examiner (a)

Fig. 8

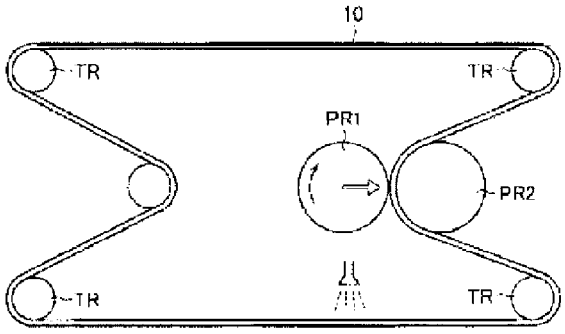

Fig. 9

| | High hardness part | Low hardness part | Ratio of high to low hardness part | Time until occurrence of cracks | Parts in which cracks occurred |
|---|---|---|---|---|---|
| Example 1 | 95 deg. | 93 deg. | 1 : 1 | 500 h or more | no cracks |
| Example 2 | 95 deg. | 93 deg. | 5 : 1 | 500 h or more | no cracks |
| Example 3 | 95 deg. | 93 deg. | 9 : 1 | 500 h or more | no cracks |
| Example 4 | 93 deg. | 90 deg. | 1 : 1 | 300 h | land part |
| Example 5 | 93 deg. | 90 deg. | 5 : 1 | 420 h | land part |
| Example 6 | 93 deg. | 90 deg. | 9 : 1 | 400 h | land part |
| Comparative Example 1 | 95 deg. | 95 deg. | - | 100 h | groove bottom corner part |
| Comparative Example 2 | 93 deg. | 93 deg. | - | 150 h | land part |
| Comparative Example 3 | 90 deg. | 90 deg. | - | 80 h | land part |

SHOE PRESS BELT

This application is a 371 of PCT/JP10/01281 filed 25 Feb. 2010

TECHNICAL FIELD

This invention relates to a belt for a shoe press (hereinafter referred to as "shoe press belt") for use in a shoe press device for papermaking, and more particularly to a shoe press belt having excellent durability.

BACKGROUND ART

Shoe press devices conventionally used in a press part for papermaking can be roughly classified into the two types shown in FIGS. 1 and 2.

In both of these types, a roll R and a shoe SH are in surface contact with each other, and two endless felts F1, F2 and a shoe press belt 10A are pinched between the roll R and the shoe SH. The wet paper web P to be dewatered is placed on top of a shoe press belt 10A while being supported between the endless felts F1, F2 and passes the nip press part N composed of the roll R and the shoe SH so as to be dewatered.

In these devices, as shown in FIGS. 1 and 2, a wide nip press part N is made by the surface contact of the roll R and the shoe SH so as to improve the dewatering effect.

In the device of FIG. 1, a relatively long shoe press belt is used; this shoe press belt, which is made into an endless shape, is trained around a plurality of rollers r (5 rollers in FIG. 1) and travels at a fixed tension.

On the other hand, in the device of FIG. 2, a relatively short shoe press belt is used.

FIG. 3 (*a*) is a cross-sectional view in the cross machine direction (CMD) of the shoe press belt 10A according to the prior art, which can be used in the shoe press devices of FIGS. 1, 2.

This shoe press belt 10A comprises a substrate B, a wet paper web-side layer 20 provided on the outer side of the substrate B and a shoe-side layer S on the inner side; the wet paper web-side layer 20 and the shoe-side layer S are made from a high-polymer elastic material.

A high-polymer elastic material is also provided inside the substrate B. All of the high-polymer elastic materials comprised in the shoe press belt 10A are made into a single body.

The substrate B is provided to give strength to the shoe press belt 10A; substrates made by superimposing a MD (machine direction) yarn and a CMD (cross-machine direction) yarn without weaving, substrates made by winding fine belt-shaped unwoven or woven fabrics into a spiral shape in the widthwise direction, or the like, as well as a base fabric woven from a MD yarn and a CMD yarn, may be used as long as the function as substrate is fulfilled.

In a shoe press belt manufacturing process, the wet paper web-side layer 20 and the shoe-side layer S can be made, in relation to the substrate B, in separate processes or in one process. The high-polymer elastic material may be a gum or an elastomer; among these, however, polyurethane resins, in particular thermosetting polyurethane resins, are frequently used.

A concave water catching part 40, provided in a surface layer 11, which will be explained below, of the wet paper web-side layer 20, has the function of temporarily capturing the moisture squeezed out of the wet paper web at the nip press part N. The moisture captured in the water catching part 40 is thereafter shaken off from the shoe press belt 10A and drained when the shoe press belt 10A travels and its traveling angle changes.

Specifically, the water catching part 40 is made by forming concave grooves continuously provided along the machine direction (MD) or a plurality of blind drill holes independently provided at a depth that does not reach the substrate.

FIG. 3 (*a*) shows a water catching part 40 in which the cross-section is formed by straight lines and the corners of the bottom part are formed by right angles; however, there are also cases in which the water holding function is fulfilled, wherein the bottom part of the water catching part 40 is entirely curved, as in FIG. 3 (*b*), the bottom part is a depression with a sharp angle, as in FIG. 3 (*c*), or wherein the water catching part 40 is in the shape of a so-called dovetail groove with a narrow entrance and a wide inner part, as in FIGS. 3 (*d*) to (*f*).

The surface layer 11 of the wet paper web-side layer comprises concave water catching parts 40 and land parts 50, which are the projecting parts produced when the water catching parts 40 are formed.

FIG. 4 is a cross-sectional view in the cross machine direction (the direction intersecting the traveling direction at a right angle) of a conventional shoe press belt wherein the surface layer of the wet paper web side comprising the water catching parts is made from a high-polymer elastic material of high hardness and the other layers are made from a high-polymer elastic material of low hardness. (Patent document 1)

When a shoe press belt is used, extremely strong compression forces working in the thickness direction of the shoe press belt and so-called shearing forces working in the direction opposite the traveling direction repeatedly act on the shoe press belt during the operation of a papermaking machine; therefore, the high-polymer elastic materials gradually deteriorate and, in the end, are unable to follow these loads, with the result that cracks occur from all parts.

CITATION LIST

Patent Literature

[Patent document 1] U.S. Pat. No. 5,766,421

SUMMARY OF INVENTION

Technical Problem

In recent years, as a result of improving the productivity in papermaking, the speed of papermaking machines has been increased and the nip pressure of shoe press devices has been set at higher values. Thus, shoe press belts with a high degree of durability that are not easily damaged under severe operating conditions are in demand.

As mentioned before, when the shoe press belt 10A is used, extremely high loads are applied in its thickness direction inside the nip press part because the shoe press belt 10A travels at high speed while a high pressure is applied inside the nip press part.

Moreover, the reverse force of the traveling direction (the machine direction) acts as a load on the surface layer 11 of the wet paper web-side layer of the belt. This means that the part that is directly after the shoe press belt part that passes the nip press part is still inside the nip press part, and even though the place that has come out of the nip press part tries to move in the machine direction, the load in the thickness direction is added inside the nip press part which is the part directly thereafter; therefore, this load acts as a breaking force, and a reverse direction load of the machine direction is added.

FIG. 5 is an illustrative view of a conventional shoe press belt constitution according to Patent document 1, which shows cracks occurring when the wet paper web-side layer is made from a high-polymer elastic material of high hardness.

In this case, cracks CR occur particularly in the bottom part and the corner parts 43 of the water catching part 40 because the high-polymer elastic material is of high hardness.

FIG. 6 is an illustrative view of a conventional shoe press belt constitution, which shows cracks occurring when the wet paper web-side layer is made from high-polymer elastic material of low hardness.

In this case, there are hardly any cracks CR occurring inside the water catching part 40 because the high-polymer elastic material is of low hardness.

On the other hand, since the high-polymer elastic material is of low hardness, the strain corresponding to the reverse load of the traveling direction (MD) cannot easily be followed; therefore, cracks CR in the surface 52 of the land part 50 have become significant.

The object of the present invention, as a reflection of the above-mentioned problems, is to provide a shoe press belt of high durability capable of suppressing the occurrence of cracks.

Solution to Problem

The present invention solves the above-mentioned problems by a shoe press belt made from a substrate, a wet paper web-side layer and a shoe-side layer, which is to be interposed between the press roller and the shoe of a shoe press device; wherein the wet paper web-side layer is made from a high-polymer elastic material, land parts and concave water catching parts are formed in the surface layer of the wet paper web-side layer, the hardness of a surface part of the land part is higher than the hardness of a bottom part of the water catching part.

Further, in the present invention, the hardness of the surface part of the land part is in the range of 93 to 97 degrees according to JIS-A, the hardness of the bottom part of the water catching part is in the range of 90 to 95 degrees according to JIS-A, and the hardness of the surface part of the land part is greater than the hardness of the bottom part of the water catching part by 1 to 5 degrees, preferably by 1 to 3 degrees, according to JIS-A.

Advantageous Effects of Invention

According to the present invention, the durability of a shoe press belt can be remarkably improved because, by setting the hardness of the surface part of the land part at a relatively high value, and by setting the hardness of the bottom part of the water catching part at a relatively low value, the occurrence of cracks in the surface part of the land part and the occurrence of cracks in the bottom part of the water catching part can be suppressed at the same time.

Moreover, since the surface part of the land part is made from a high-polymer elastic material of high hardness, the water catching parts (groove parts) do not close even when the shoe press belt is used under severe conditions; thus the dewatering effect can be maintained.

BRIEF DESCRIPTION OF DRAWINGS

FIGS. 3 (*b*) to (*f*) are enlarged cross-sectional views in the cross machine direction of the water catching parts with different cross-sectional shapes.

FIG. 7 (*b*) is a partially enlarged cross-sectional view in the cross machine direction of a shoe press belt according to the present invention, showing a water catching part provided in the surface layer of the wet paper web-side layer.

FIG. 8 is a schematic view of a device for evaluating the durability of the shoe press belts according to the Examples and Comparative Examples.

FIG. 9 is a view showing the result of the evaluation by the device of FIG. 8.

DESCRIPTION OF EMBODIMENTS

Figure 1:
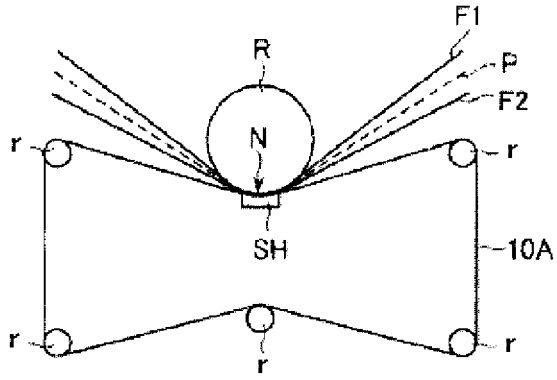
FIG. 1 is a schematic view of a shoe press device suitable for a relatively long shoe press belt.
Figure 2:
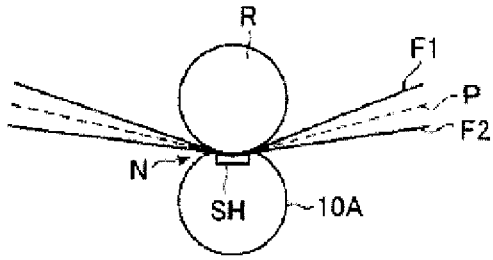
FIG. 2 is a schematic view of a shoe press device suitable for a relatively short shoe press belt.

An embodiment of the shoe press belt 10 according to the present invention will now be explained with reference to FIG. 7 (*a*). Descriptions of the constitution that is identical to the prior art will be omitted, and reference characters identical to those in the prior art will be used. A shoe press belt 10 is made from a substrate B, a wet paper web-side layer 20 provided on the wet paper web side of the substrate B, and shoe-side layer S provided on the shoe side; the wet paper web-side layer 20 and the shoe-side layer S are made from a high-polymer elastic material. A surface layer 11 of the wet paper web-side layer 20 comprises concave water catching parts 40 and land parts 50 which are the projecting parts produced when the water catching parts 40 are formed. By setting the hardness of a surface part 52 of the land part 50 at a higher value than the hardness of a bottom part 42 of the water catching part 40, the durability of the shoe press belt 10 is improved. The term "surface part of the land part" refers to a part with a thickness that extends from the surface of the land part in the thickness direction, but does not reach the bottom of the water catching parts.

Next, a manufacturing method of the shoe press belt 10 will be described with reference to FIG. 7.

Firstly, the wet paper web-side layer 20 and the shoe-side layer S are provided in relation to the substrate B. Each layer can be formed independently, or the layers can be formed continuously. The high-polymer elastic material selected for making the wet paper web-side layer 20 is, however, a high-polymer elastic material having low hardness. A low hardness part 31*b* is formed by this high-polymer elastic material having low hardness.

Next, a high-polymer elastic material of high hardness is coated and cured on the low hardness part 31*b*. A high hardness part 31*a* is formed by this high-polymer elastic material of high hardness.

Thereafter, the water catching parts 40 are provided in a surface layer 11 of the wet paper web-side layer 20 of the shoe press belt 10. At this stage, the high hardness part 31*a* in which no water catching part 40 is provided becomes the surface part 52 of the land part 50. In this way, the shoe press belt 10 according to the present invention is manufactured.

Figure 7:
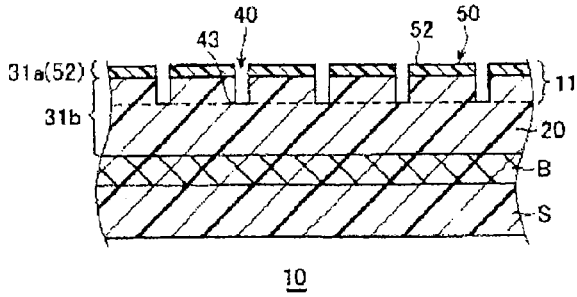
FIG. 7 (*a*) is a cross-sectional view in the cross machine direction showing a shoe press belt according to the present invention.
Figure 7:
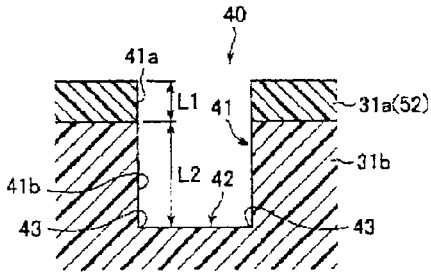

As shown in FIG. 7 (*b*), in sidewalls 41 of the water catching part 40, a high hardness part 41*a* of the side surfaces is formed by the high hardness part 31*a*, and a low hardness part 41*b* of the side surfaces is formed by the low hardness part 31*b*. The bottom part 42 and the corner parts 43 of the water catching part 40 are formed by the low hardness part 31*b*.

In this way, of the places where cracks tend to occur, i.e. the surface part 52 of the land part 50 and the bottom part 42 and the corner parts 43 of the water catching part 40, the surface part 52 of the land part 50 is made from the high hardness part 31*a* and the bottom part 42 and the corner parts 43 of the water catching part 40 are made from the low hardness part 31*b*, as a result of which it is possible to suppress the occurrence of cracks. The bottom part 42 and the corner parts 43 of the water catching part 40 are formed from the same low hardness part 31*b*; according to the present invention it is therefore sufficient to set the hardness of the bottom part 42 of the water catching part 40.

The high-polymer elastic material used in the present invention may be a gum or an elastomer; among these, however, polyurethane resins, in particular thermosetting polyurethane resins, are frequently used.

The results of the experiments confirm that the desired effect is obtained when the hardness of the high hardness part 31*a* is in the range of 93 to 97 degrees, preferably in range of 95 to 97 degrees, according to JIS-A, the hardness of the bottom part 42 of the water catching part 40 is in range of 90 to 95 degrees, preferably in range of 93 to 95 degrees, according to JIS-A, and the hardness of the surface part 52 of the land part 50 is greater than the hardness of the bottom part 42 of the water catching part 40 by 1 to 5 degrees, preferably by 1 to 3 degrees, more preferably by 1 to 2.5 degrees, according to JIS-A.

At the border between the high hardness part 31*a* and the low hardness part 31*b*, each part may be of a completely different hardness than the other, or a hardness gradient may be formed between the two.

According to the present invention, in order to make the high hardness part 31*a* and the low hardness part 31*b* from high-polymer elastic materials of different hardness, it is possible, when for example polyurethane resins are used, to suitably blend and adjust urethane prepolymers having long-chain polyols of different molecular weights (Mw). According to the present invention, it is possible to suitably blend Adiprene L167 and Adiprene L100 (these long-chain polyols are PTMEGs, the former has a lower molecular weight (Mw) than the latter) produced by Chemtura Corporation for forming the high hardness part 31*a* and the low hardness part 31*b*.

The results from the experiments confirm that the preferred thickness ratio L1:L2 between the high hardness part 41*a* of the side surfaces and the low hardness part 41*b* of the side surfaces is between 9:1 and 1:1.

In such a constitution, the cross-sectional shape of the water catching part can be rectangular, trapezoidal, in the shape of the letter "U", barrel-shaped, or the like.

In the above embodiment, an example has been described in which the cross-section of the water catching part 40 is formed by straight lines and the corner parts 43, between the side walls 41 and the bottom surface 42, are formed by right angles. The present invention is, however, not limited to such a typical constitution; it can also be applied to water catching parts with other cross-sections.

Figure 3:
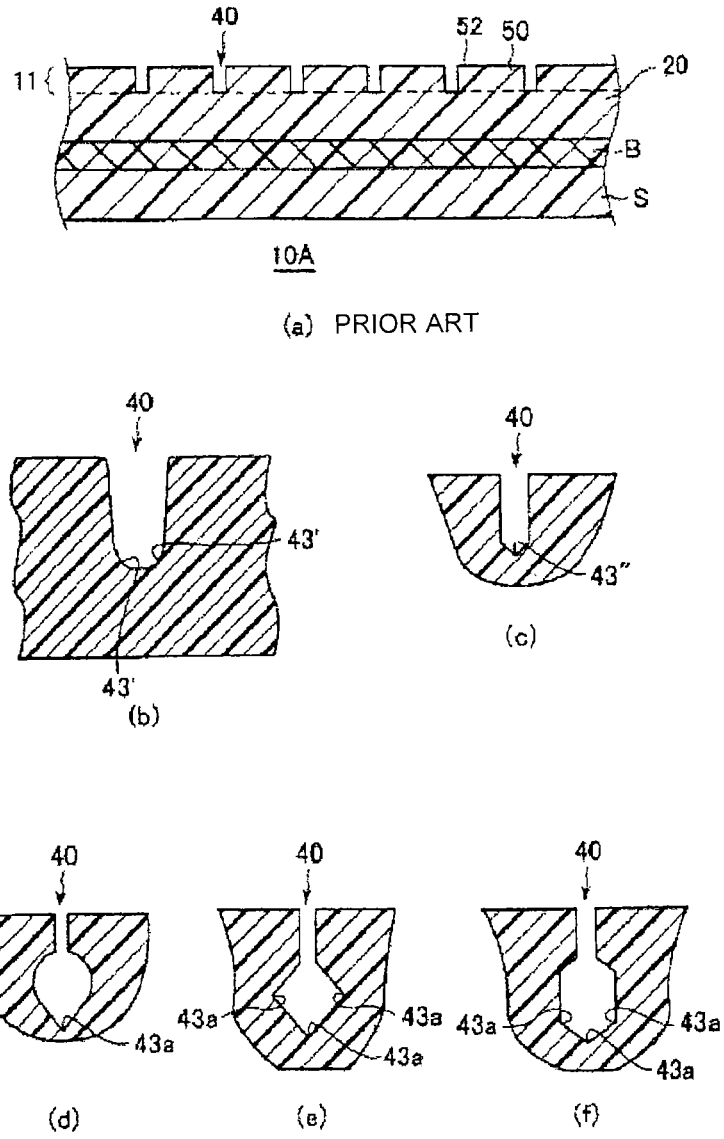
FIG. 3 (*a*) is a cross-sectional view in the cross machine direction of a conventional shoe press belt.
Figure 4:
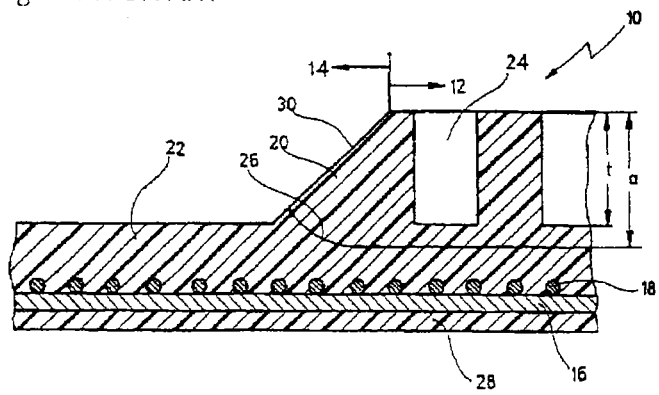
Fig. 4 PRIOR ART
FIG. 4 is a cross-sectional view in the cross machine direction of a conventional shoe press belt.
Figure 5:
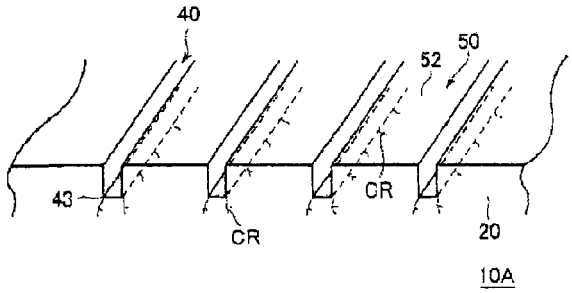
Fig. 5 PRIOR ART
FIG. 5 is an illustrative view showing cracks occurring in the bottom part and the corner parts of water catching parts when the wet paper web-side layer in a conventional shoe press belt is formed by a high-polymer elastic material of high hardness.
Figure 6:
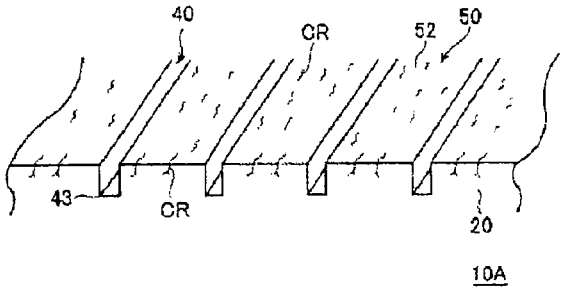
Fig. 6 PRIOR ART
FIG. 6 is an illustrative view showing cracks occurring in the surface part of the land part when the wet paper web-side layer in a conventional shoe press belt is formed by a high-polymer elastic material of low hardness.

In such cases, as in FIG. 3 (*b*), in which the water catching part 40 has a bottom surface, which comprises corner parts 43', is entirely curved, or as in FIG. 3 (*c*), in which the water catching part 40 has a depressed bottom surface which comprises a point 43" formed by a sharp angle, or as in FIGS. 3 (*d*) to (*f*), in which the water catching part 40 is in the shape of a dovetail groove with a narrow entrance and a wide inner part and the bottom surface comprises the parts 43*a* formed by certain angles, the high-polymer elastic material forming these bottom surfaces may consist of low hardness parts set at a lower hardness than that of the surface part of the land part.

EXAMPLES

Next, specific shoe press belts will be described by the Examples 1 through 6 and the Comparative Examples 1 thorough 3. The constitution which is common to the shoe press belts of the Examples 1 through 6 and the Comparative Examples 1 thorough 3 is as follows:

Width: 300 mm

Perimeter length: 6 m

Thickness: 5 mm

Substrate B: triple weave woven from a MD yarn and a CMD yarn, both of which were polyester monofilament yarns.

High-polymer elastic material: a mixture of Adiprene L167 and Adiprene L100 produced by Chemtura Corporation, to which the hardener Cuamine MT produced by Ihara Chemical Industry Co., Ltd. was added so as to obtain the required resin hardness, was used as thermosetting polyurethane resin.

Water catching part 40: rectangular water catching parts with a width of 1 mm, a depth of 1 mm and a pitch of 16 peaks per 5 cm were formed as continuous groove parts in the surface layer 11 of the wet paper web-side layer.

The hardness of the high hardness part and the hardness of the low hardness part as well as the thickness ratio between the side face high hardness part and the side face low hardness part are shown in the Table.

The device shown in FIG. 8 was used to perform experiments for evaluating the durability of the shoe press belts of Examples 1 through 6 and Comparative Examples 1 through 3.

FIG. 8 is a flexural test apparatus which is composed of a plurality of tension rollers TR and a pair of press rolls PR1, PR2. The press roll PR1 is provided so that it is both rotatable and, in relation to the press roll PR2, movable. Thus, the test specimen, which is supported by the tension rollers TR, can be made to travel, and, at the same time, a press pressure can be applied on the test specimen.

The diameter of the tension rollers TR was 100 mm and the diameter of the press rolls PR1, PR2 was 200 mm.

The above-mentioned shoe press belts were first installed in the test apparatus so that the water catching parts 40 were on the side of the internal perimeter.

While water was supplied to the internal perimeter, the shoe press belts were then made to travel under the conditions given below, and were stopped and observed for periods of 50 hours, each, to measure the time until the occurrence of cracks was observed.

Traveling speed: 500 m/min.

Press pressure: 1500 kN/m

Tension: 10 kN/m

The test results given in FIG. 9 confirm that the shoe press belts according to the present invention in the Examples had better durability than the shoe press belts in the Comparative Examples and that they were effective in preventing the occurrence of cracks.

REFERENCE SIGNS LIST

10: Shoe press belt
11: Surface layer
B: Substrate
S: Shoe-side layer
20: Wet paper web-side layer
40: Water catching part
41: Side walls of the water catching part
41*a*: Side surface of the high hardness part
41*b*: Side surface of the low hardness part
42: Bottom surface of the water catching part
43: Corner part of the water catching part
50: Land part
52: Surface part of the land part

The invention claimed is:

1. A shoe press belt configured to be interposed between a press roller and a shoe of a shoe press device, comprising:

a substrate;

a wet paper web-side layer, which is provided on the wet paper web side of the substrate and includes concave water catching parts and land parts that are projecting parts produced when the water catching parts are formed; and a shoe-side layer, which is provided on the shoe side of the substrate, wherein the wet paper web-side layer is made from polymer elastic materials, and wherein a hardness of a surface part of the land part is higher than a hardness of a bottom part of the water catching part.

2. A shoe press belt according to claim 1; wherein the hardness of the surface part of the land part is in the range of 93 to 97 degrees according to JIS-A, the hardness of the bottom part of the water catching part is in the range of 90 to 95 degrees according to JIS-A, and the hardness of the surface part of the land part is greater than the hardness of the bottom part of the water catching part by 1 to 5 degrees according to JIS-A.

3. A shoe press belt according to claim 2; wherein the hardness of the surface part of the land part is greater than the hardness of the bottom part of the water catching part by 1 to 3 degrees according to JIS-A.

4. A shoe press belt according to claim 3; wherein each side wall of the water catching part comprises a high hardness part and a low hardness part, and the thickness ratio between the high hardness part and the low hardness part is between 9:1 to 1:1.

5. A shoe press belt according to claim 2; wherein each side wall of the water catching part comprises a high hardness part and a low hardness part, and the thickness ratio between the high hardness part and the low hardness part is between 9:1 to 1:1.

6. A shoe press belt according to claim 1; wherein each side wall of the water catching part comprises a high hardness part and a low hardness part, and the thickness ratio between the high hardness part and the low hardness part is between 9:1 to 1:1.

* * * * *